US006723000B1

(12) United States Patent
Dombrowski

(10) Patent No.: US 6,723,000 B1
(45) Date of Patent: Apr. 20, 2004

(54) ADJUSTABLE PUTTER HEAD AND CLUB SHAFT COMBINATION GOLF PUTTER

(76) Inventor: Doug C. Dombrowski, 453 Library Ave., Carnegie, PA (US) 15106

( * ) Notice: Subject to any disclaimer, the term of this patent is extended or adjusted under 35 U.S.C. 154(b) by 328 days.

(21) Appl. No.: 09/821,902

(22) Filed: Mar. 30, 2001

(51) Int. Cl.[7] ..... A63B 69/36; A63B 53/06

(52) U.S. Cl. ..... 473/239; 473/248; 473/296; 473/306

(58) Field of Search ..... 473/244, 245, 473/246, 247, 248, 296, 288, 313, 314, 305, 306, 307, 308, 309, 310, 311, 312, 315, 239

(56) References Cited

U.S. PATENT DOCUMENTS

| | | | | |
|---|---|---|---|---|
| 1,697,846 | A | * | 1/1929 | Anderson |
| 2,027,452 | A | * | 1/1936 | Rusing |
| 2,091,794 | A | * | 8/1937 | Pester |
| 2,214,079 | A | * | 9/1940 | Horton |
| 2,691,525 | A | * | 10/1954 | Callaghan |
| 2,882,053 | A | * | 4/1959 | Lorthiois |
| 2,932,515 | A | | 4/1960 | May |
| 3,143,349 | A | | 8/1964 | MacIntyre |
| 4,324,404 | A | | 4/1982 | Dian |
| 4,411,430 | A | | 10/1983 | Dian |
| 4,815,740 | A | * | 3/1989 | Williams |
| 4,962,932 | A | | 10/1990 | Anderson |
| 5,083,779 | A | * | 1/1992 | Ungermann |
| 5,133,553 | A | * | 7/1992 | Divnick |
| 5,385,346 | A | * | 1/1995 | Carroll |
| 5,388,827 | A | | 2/1995 | Reynolds, Jr. |
| 5,533,725 | A | | 7/1996 | Reynolds, Jr. |
| 5,692,969 | A | | 12/1997 | Schooler |
| 5,749,790 | A | | 5/1998 | Van Alen, II et al. |
| 5,863,257 | A | | 1/1999 | Busnardo |
| 6,001,024 | A | | 12/1999 | Van Alen, II et al. |
| 6,056,647 | A | | 5/2000 | Tingelstad |

* cited by examiner

*Primary Examiner*—Sebastiano Passaniti

(57) ABSTRACT

An adjustable putter head and club shaft combination golf putter is adjustable in both shaft length and head angle. A main shaft includes a second shaft portion which telescopes inside a first shaft portion for adjusting the length of the main shaft. A gear assembly located between the second shaft portion and the putter head creates pivoting action of the putter head. When the main shaft is telescopically extended to its longest length, the putter head is located at almost a right angle with respect to the main shaft. As the main shaft is shortened, the putter head increases its angle to approximately 15° in a directly proportional manner.

14 Claims, 4 Drawing Sheets

ADJUSTABLE PUTTER HEAD AND CLUB SHAFT COMBINATION GOLF PUTTER

RELATED APPLICATIONS

The present invention was first described in Disclosure Document No. 475,353 filed on Jun. 9, 2000. There are no previously filed, nor currently any co-pending applications, anywhere in the world.

BACKGROUND OF THE INVENTION

1. Field of the Invention

The present invention relates generally to an adjustable golf club and, more particularly, to an adjustable putter head and club shaft combination golf putter.

2. Description of the Related Art

The game of golf has become one of the most technologically advanced sports in the world today. Experts in science and physics have combined state of the art materials with ergonomic and aerodynamic principles in order to produce golf clubs and golf balls that produce more accurate and consistently longer golf shots. In fact, 1997 saw the first golfer in PGA history to average over 300 yards per drive. As a result of such popularity, many people are joining the ranks of the playing public.

Accordingly, to satisfy the equipment needs of the golfing public, manufacturers are constantly looking for new and improved golf balls, golf clubs and associated equipment to aid in improving one's score. The development of the adjustable putter head and club shaft combination golf putter fulfills this need.

A search of the prior art did not disclose any patents that read directly on the claims of the instant invention; however, the following references were considered related. The following patents disclose an adjustable putter head for a golf club: U.S. Pat. No. 6,056,647 issued in the name of Tingelstad; U.S. Pat. No. 6,001,024 issued in the name of Van Alen, II et al.; U.S. Pat. No. 5,863,257 issued in the name of Busnardo; U.S. Pat. No. 5,749,790 issued in the name of Van Alen, II et al.; U.S. Pat. No. 5,692,969 issued in the name of Schooler, U.S. Pat. No. 4,411,430 issued in the name of Dian; U.S. Pat. No. 4,324,404 issued in the name of Dian; and U.S. Pat. No. 2,932,515 issued in the name of May.

The following patents describe a golf club with removable shafts and weights: U.S. Pat. No. 5,533,725 issued in the name of Reynolds, Jr.; and U.S. Pat. No. 5,388,827 issued in the name of Reynolds, Jr.

U.S. Pat. No. 4,962,932 issued in the name of Anderson discloses a golf putter head with an adjustable weight cylinder.

U.S. Pat. No. 3,143,349 issued in the name of MacIntyre describes a golf club head having weight receiving recesses.

Consequently, a need has been felt for providing an adjustable putter head and club shaft combination golf putter which allows for better golf scores by providing a putter that can be custom matched to each hole played.

SUMMARY OF THE INVENTION

Therefore, it is an object of the present invention to provide an adjustable golf putter with an adjustable shaft length and head angle.

It is another object of the present invention to provide a device which improves one's golf score.

It is still another object of the present invention to reduce the number of putters that must be carried.

It is still another object of the present invention to provide a device which can be optimized by a golfer at each hole.

It is another object of the present invention to provide a device with an adjustable shaft length which allows such length to vary by up to 18 inches.

It is another object of the present invention to provide a device with an adjustable shaft length which is controlled by a locknut located midway on shaft.

It is another object of the present invention to provide a device with an adjustable shaft length which can be quickly adjusted.

It is another object of the present invention to provide a device with an adjustable putter head which is controlled by a gear assembly.

It is another object of the present invention to provide a device with an adjustable putter head which allows the putter head to be kept constantly parallel to the ground.

It is another object of the present invention to provide a device with an adjustable putter head which will add an additional 15° with respect to the angle formed by the putter head and shaft when such shaft is at its shortest length.

It is another object of the present invention to provide a device whereby the putter head can be interchanged.

Briefly described according to one embodiment of the present invention, an adjustable putter head and club shaft combination golf putter is disclosed. The present invention is a golf putter that is adjustable in both shaft length and head angle. Upon initial observation, the invention looks remarkably like a conventional putter. But after closer inspection, it can be seen that a lock nut, located midway down the shaft, can be loosened to allow the overall shaft length to vary by 18 inches. Additionally, at its longest length, the putter head is located at almost a right angle to the putter shaft. As the shaft is extended out 18 inches, the putter head decreases its angle to approximately 15° in a directly proportional manner. This feature is accomplished with the use of a gear assembly located between the shaft and the putter head. Thus an extended club shaft with a perpendicular putter head can be used when directly over the golf ball, and a shorter putter with an angle of approximately 105° relative the club shaft can be used when standing farther back, yet while keeping the putter head parallel to the ground under both instances. It is also envisioned that the putter head can be completely interchanged as well.

The use of the present invention allows for better golf scores by providing a putter that can be custom matched to each hole played.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
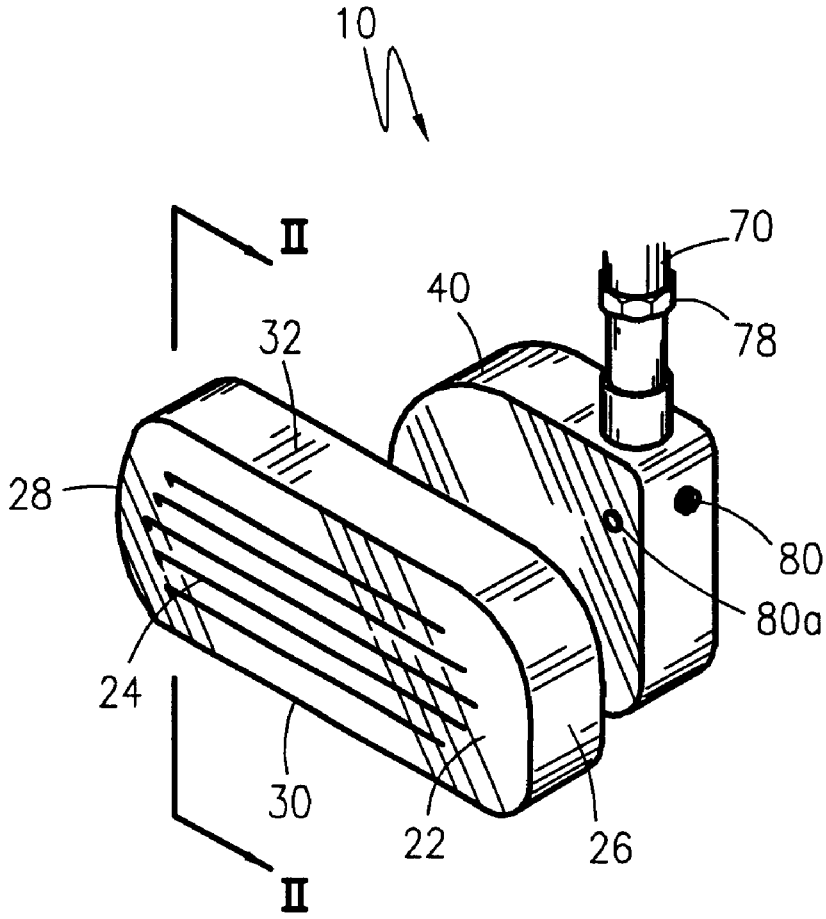
FIG. 1 is a perspective view of an adjustable putter head and club shaft combination golf putter according to the preferred embodiment of the present invention.
Figure 2:
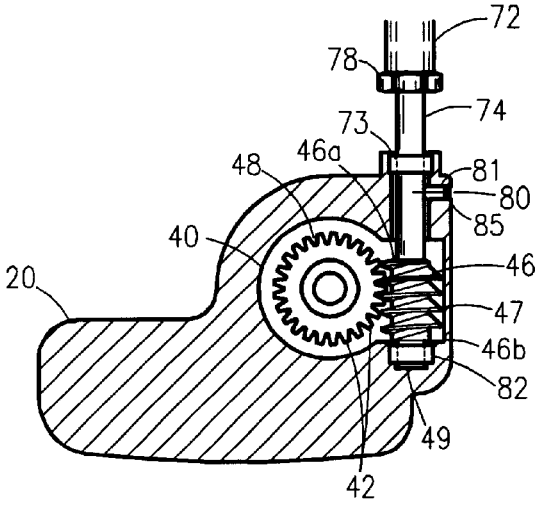
FIG. 2 is a cross-sectional view taken along lines II—II of FIG. 1 according to the preferred embodiment of the present invention.
Figure 3:
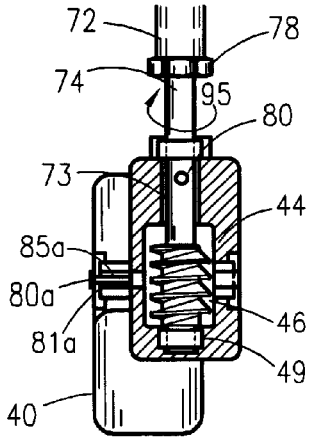
FIG. 3 is a partial cross-sectional view of the rear side of the present invention according to the preferred embodiment.

Referring now to FIGS. 1–6, a pivotably adjustable putter head and telescopically adjustable club shaft combination golf putter 10 is shown, according to the present invention, comprised of an adjustable, pivotable putter head 20 and telescopically adjustable club shaft 70 which provides both a long putter with a perpendicular putter head 20 when standing directly over a golf ball for short pufts, and a short putter with a club shaft 70 having an increased angle, while the putter head 20 remains parallel to the ground for long putts.

The putter head 20 is formed of stainless steel and comprises a putter head body 22 with a generally flat striking surface 24, a heel 26, a toe 28, a top surface 32, and a sole 30.

The putter head 20 is further defined as having a worm gear 40 molded integral therewith along the top surface 32, near the heel 26 of the putter head 20.

An elongated, circular mating worm cavity 44 is formed on the top surface 32 behind teeth 42 of the worm gear 40 for housing a mating worm 46 and a second shaft portion 74 of the club shaft 70 (to be described in greater detail below).

The telescopically adjustable club shaft 70 includes a first shaft portion 72 and a second shaft portion 74. The club shaft 70 is designed and configured such that the second shaft portion 74 telescopes inside the first shaft portion 72. It is envisioned that an entire linear extendable length of the club shaft 70 will vary approximately 18 inches between its shortest and longest length. Once a desired position has been chosen by a user, the first shaft portion 72 and the second shaft portion 74 are locked into such position via a locking nut 78 located at a lower end of the first shaft portion 72. The second shaft portion 74 tapers slightly in a direction away from the first shaft portion 72 with a lower end thereof defined by a linearly elongated mating worm 46 molded integral thereto.

Pivoting action of the putter head 20 is accomplished via a gear assembly 50 which is designed and configured so as to cooperate conjunctively with the worm gear 40. The gear assembly 50 is comprised of the mating worm 46, a plurality of vertical rotation guide members 73, and bearings 82.

The mating worm 46 is comprised of an anterior end 46*a* opposite a posterior end 46*b* and includes a series of circumferentially aligned detendes 47 extending from the anterior end 46*a* to the posterior end 46*b* thereof.

The posterior end 46*b* of the mating worm 46 is rotatably mounted within a support hub 49 molded integral with the worm gear 40.

In order to facilitate frictionless free rotation of the mating worm about its posterior end 46*b*, bearings 82 are disposed at a mounting point of the posterior end 46*b* thereof.

The worm gear 40 of the putter head 20 includes a series of teeth 42 formed integral therewith, aligned centrally at spaced locations which occupy approximately one-half of the external circumferential surface of a rear side thereof. The spacing between the teeth 42 define recesses 48, wherein detendes 47 of the mating worm 46 are designed to mesh therewith.

A plurality of linearly elongated, rigid vertical guide members 73, preferably three, mountably reside vertically within the second shaft portion 74, and have upper ends which protrude beyond a top end of the second shaft portion 74. The upper ends of the guide members 73 are mounted to an internal circumferential sidewall of the first shaft portion 72. Lower ends of the guide members 73 extend into and are embedded within the mating worm 46.

Referring now in greater detail in conjunction with FIGS. 2–5, the telescopically adjustable club shaft 70, the vertical rotation guide members 73, the worm gear 40, and the gear assembly 50 provide structural, functional features according important utility to the present invention.

Telescopic adjustment of the club shaft 70 by a user translates linear motion of the first shaft portion 72 into rotational movement by the guide members 73 within the second shaft portion 74, thereby serving to increase or decrease an angle of the putter head 20 up to approximately 15° in a directly proportional manner.

Figure 4:
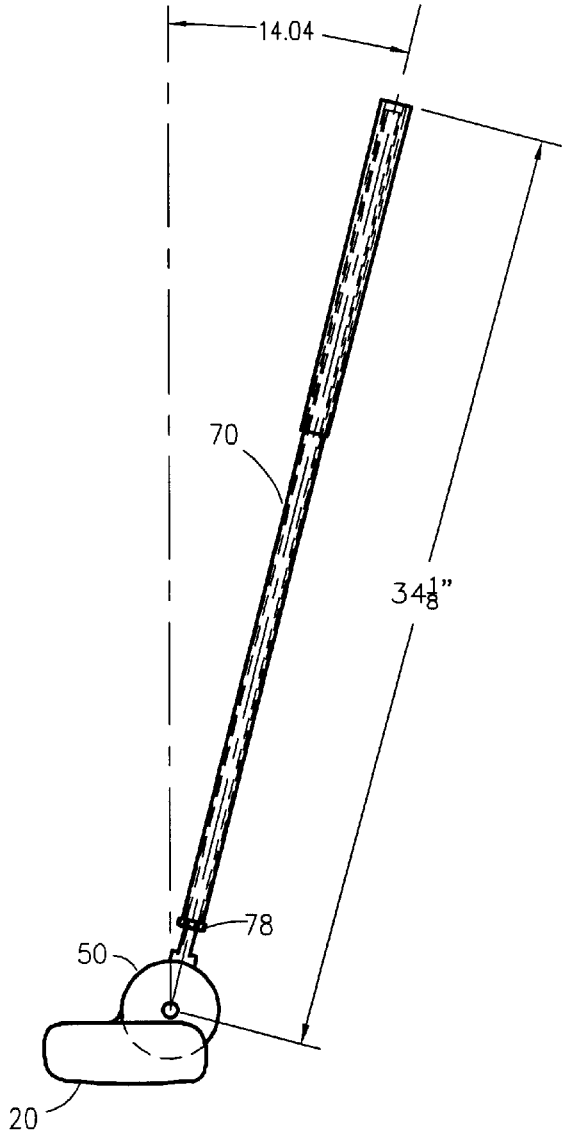
FIG. 4 is a side elevational view of the present invention shown with the putter head pivoted at angle greater than 90° according to the preferred embodiment.

Specifically, exerting downward force on the first shaft portion 72 actuates a translation of such force into clockwise rotation of the guide members as the club shaft 70 is shortened telescopically. Being mounted within the second shaft portion 74, the aforementioned rotational action by the guide members 73 serves to simultaneously actuate clockwise rotation of the second shaft portion 74 as shown by direction arrow 95, thereby facilitating clockwise rotation of the mating worm 46, and in turn, actuating rotational pivoting by the worm gear 40 which allows the putter head 20 to be pivoted at an angle greater than 90° relative to the club shaft 70, directly proportional to the distance the Club shaft 70 is shortened, as shown in FIG. 4.

Figure 5:
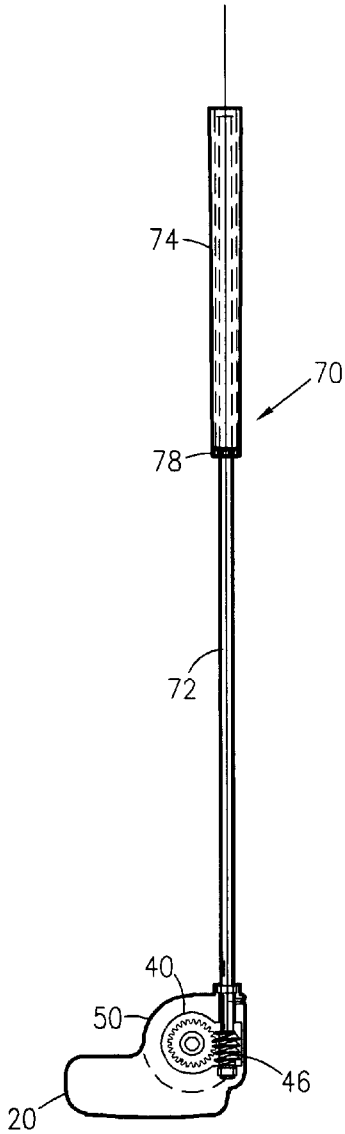
FIG. 5 is a side elevational view of the present invention shown with the putter head positioned at an angle of approximately 90° according to the preferred embodiment.
Figure 6:
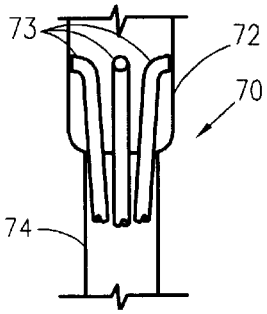
FIG. 6 is a partial cross-sectional view of the club shaft showing attachment of the guide members to the first shaft portion according to the preferred embodiment of the present invention.

As shown in FIG. 5, when the telescopic club shaft 70 is at its longest length, the putter head 20 is positioned perpendicular and at an angle of approximately 90° relative to the club shaft 70. As the club shaft 70 is shortened, the putter head 20 increases its angle to approximately 15° in a directly proportional manner, thereby providing a putter head 20 with an angle of approximately 105° relative to the club shaft 70, while the sole 30 of the putter head 20 remains parallel to the ground.

In order to securely hold the putter head 20 in a desired position, a first set screw 80 is inserted through a threaded aperture 81 formed in the mating worm cavity 44 located above the mating worm 46, through a threaded bore 85 to an outer surface of the second shaft portion 74.

In order to facilitate and ensure the putter head 20 remains immobile once a desired position has been chosen by a user, a second set screw 80*a* is inserted through a threaded aperture 81*a* formed in the lateral sidewall of the worm gear 40, through a threaded bore 85*a* to an outer surface of the second shaft portion along a linearly elongated centerline thereof.

Figure 7A:
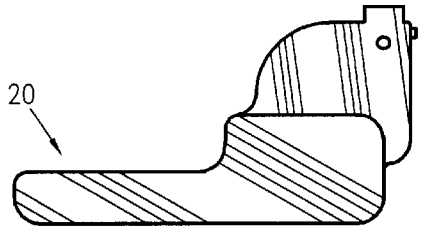
FIGS. 7*a*, 7*b*, and 7*c* show a plurality of interchangeable putter heads in various shapes.
Figure 7B:
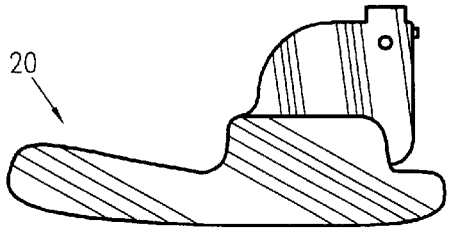
Figure 7C:
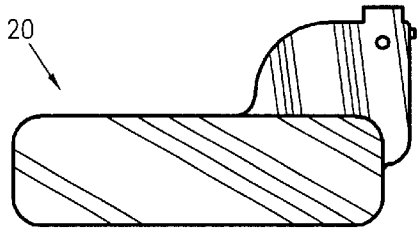

It is envisioned that the present invention is operable with and provides a plurality of interchangeable putter heads 20 in various shapes (shown in FIGS. 7*a*–7*c*). The putter head 20 of the preferred embodiment, as well as the interchangeable putter heads 20, include an integral worm gear 40 and a set screw 80. Each putter head 20 further includes the mating worm cavity 44 formed on the top surface 32 behind the worm gear 40 thereof, as discussed hereinabove according to the preferred embodiment, for housing the mating worm 46 and club shaft 70.

2. Operation of the Preferred Embodiment

To use the present invention, the user telescopically shortens the length of the club shaft 70 to its shortest length by applying a downward force thereon while making sure the putter head 20 is pivoted at an angle greater than 90° in a directly proportional manner so as to ensure proper operation of the present invention. Next, the user locks club shaft 70 into position via the locking nut 78 once the desired position has been obtained. Then, in order to securely hold the putter head 20 in position, the user tightens the set screw 80 near the heel 26 of the of the putter head 20 and tightens set screw 80*a* so as to ensure the putter head 20 remains immobile.

In the event the user would like to telescopically extend the club shaft 70 while simultaneously decreasing the putter head 20 angle in a directly proportional manner for a putt, the user simply loosens the locking nut 78, linearly extends the telescoping club shaft 70, thus simultaneously positioning the putter head 20 perpendicular and at an angle of approximately 90°, and finally locks club shaft 70 into position via the locking nut 78 once the desired position has been obtained. Then, in order to securely hold the putter head 20 in position, the user tightens the set screw 80 near the heel 26 of the of the putter head 20 and tightens set screw 80*a* so as to ensure the putter head 20 remains immobile . The user is ready to putt. In the event the user would like to again shorten the golf shaft 70, the aforementioned steps are followed in reverse order.

The use of the present invention allows for better golf scores by providing a putter that can be custom matched to each hole played.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. An adjustable putter head and club shaft combination golf putter comprising:

an adjustable, pivotable putter head; said adjustable, pivotable putter head is formed of stainless steel;

a telescopically adjustable club shaft; said telescopically adjustable club shaft includes a first shaft portion and a second shaft portion, wherein said second shaft portion telescopes inside said first shaft portion; and a gear assembly, said gear assembly actuates pivoting action of said adjustable, pivotable putter head, wherein said gear assembly is comprised of a mating worm, a plurality of vertical rotation guide members, and bearings.

2. The adjustable putter head and club shaft combination golf putter of claim 1, wherein said pivotable putter head is defined as having a putter head body with a generally flat striking surface, a heel, a toe, a top surface, and a sole.

3. The adjustable putterhead and club shaft combination golf putter of claim 1, wherein said mating worm is defined as having an anterior end opposing a posterior end and includes a series of circumferentially aligned detendes extending from said anterior end to said posterior end of said mating worm.

4. The adjustable putterhead and club shaft combination golf putter of claim 3, wherein said posterior end of said mating worm is rotatably mounted within a support hub molded integral with a worm gear.

5. The adjustable putterhead and club shaft combination golf putter of claim 4, wherein said worm gear is molded integral with said pivotable putter head along said top surface, near said heel of said pivotable putter head.

6. The adjustable putterhead and club shaft combination golf putter of claim 5, wherein said worm gear includes a series of teeth formed integral with said worm gear, wherein said series of teeth are aligned centrally at spaced locations which occupy approximately one-half of an external circumferential surface of a rear side of said worm gear, and wherein spacing between said series of teeth define recesses for having said detendes of said mating worm mesh with said recesses.

7. The adjustable putterhead and club shaft combination golf putter of claim 6, wherein said pivotable putter head has an elongated, circular worm cavity formed on said top surface behind said series of teeth of said worm gear for housing both said mating worm and said second shaft portion of said telescopically adjustable club shaft.

8. The adjustable putterhead and club shaft combination golf putter of claim 7, wherein said telescopically adjustable club shaft varies a linear extendable length of approximately 18 inches between a shortest length and a longest length of said telescopically adjustable club shaft, and wherein said telescopically adjustable club shaft locks in a desired position via a locking nut located at a lower end of said first shaft portion.

9. The adjustable putterhead and club shaft combination golf putter of claim 8, wherein said second shaft portion tapers slightly in a direction away from said first shaft portion.

10. The adjustable putterhead and club shaft combination golf putter of claim 9, wherein said second shaft portion has a plurality of linearly elongated, rigid vertical guide members mountably residing in a vertical manner within said second shaft portion, and wherein said vertical guide members have upper ends protruding beyond a top end of said second shaft portion, wherein said upper ends of said guide members are mounted to an internal circumferential sidewall of said first shaft portion, and wherein lower ends of said vertical guide members extend into and are embedded within said mating worm.

11. The adjustable putterhead and club shaft combination golf putter of claim 10, wherein said pivotable putter head is securely held in a desired position with a first set screw inserted through a threaded aperture formed in said mating worm cavity located above said mating worm and through a threaded bore to an outer surface of said second shaft portion.

12. The adjustable putterhead and club shaft combination golf putter of claim 11, wherein said pivotable putter head includes a second set screw inserted through a threaded aperture formed in a lateral sidewall of said worm gear, through a threaded bore to an outer surface of said second shaft portion along a linearly elongated centerline of said second shaft portion.

13. The adjustable putterhead and club shaft combination golf putter of claim 12, wherein said club shaft telescopically adjusts which actuates a translation of linear motion of said first shaft portion into rotational movement by said guide members within said second shaft portion, thereby serving to increase or decrease an angle of said pivotable putter head up to approximately 15° in a directly proportional manner.

14. The adjustable putterhead and club shaft combination golf putter of claim 13, wherein said pivotable putterhead is positioned perpendicular and at an angle of approximately 90° relative to said club shaft when said telescopic club shaft is telescopically extended at said longest length of said telescopic club shaft, and telescopically shortening said club shaft serves to increase an angle of said putter head to approximately 15° in a directly proportional manner, thus providing said pivotable putter head with an angle of approximately 105° relative to said club shaft, while said sole of said pivotable putter head remains parallel to ground.

* * * * *